US007384278B2

(12) United States Patent
Ho et al.

(10) Patent No.: US 7,384,278 B2
(45) Date of Patent: Jun. 10, 2008

(54) ELECTRICAL CONNECTOR

(75) Inventors: Hsin-Tsung Ho, Taipei Hsien (TW); Chung-Hsin Huang, Taipei Hsien (TW); Mei-Chuan Yang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 104 days.

(21) Appl. No.: 11/549,268

(22) Filed: Oct. 13, 2006

(65) Prior Publication Data

US 2008/0090459 A1 Apr. 17, 2008

(51) Int. Cl.
*H01R 12/00* (2006.01)

(52) U.S. Cl. ..... 439/83

(58) Field of Classification Search ..... 439/83, 439/58, 78, 81, 682
See application file for complete search history.

(56) References Cited

U.S. PATENT DOCUMENTS 5,188,535 A * 2/1993 Bertho et al. ..... 439/83
5,476,389 A * 12/1995 Ono ..... 439/83
6,146,156 A * 11/2000 Yang ..... 439/83

FOREIGN PATENT DOCUMENTS

TW 00395603 6/2000

* cited by examiner

*Primary Examiner*—Phuong K Dinh
(74) *Attorney, Agent, or Firm*—WPAT, P.C.; Anthony King

(57) ABSTRACT

An electrical connector includes an insulation housing having an insertion passage arranged at a top surface thereon, a receiving space arranged at a bottom surface thereon. An electrical contact covers the bottom surface and side surfaces of the insulation housing having a body portion covering the bottom surface, an elastic connection portion received in the receiving space, sidewalls covering the side surfaces and soldering portions. An engagement portion includes a projection member arranged at the side surface of the insulation housing and a fixing hole opened through the sidewall of the electrical contact for engaging with the projection member. While a contact of a matching device obliquely inserts into the insertion passage and presses the elastic connection portion, the electrical contact engages with the insulation housing securely via the engagement portion for preventing the electrical contact departing from the insulation housing by the pressing force from the contact of the matching device.

6 Claims, 3 Drawing Sheets

ELECTRICAL CONNECTOR

BACKGROUND OF THE INVENTION

1. Field of the Invention

The invention relates to an electrical connector, and particularly to an electrical connector including an engagement portion for ensuring that an electrical contact of the electrical connector engaged with an insulation housing of the electrical connector securely.

2. The Related Art

According to the current development of electrical technology, portable electrical devices such as mobile phones, personal digital assistants, and others, are capable of communicating with other electrical devices through electrical connectors configured therein. Because of downsizing issue and reducing weight, the size of the portable electrical device is getting smaller. Consequently, downsizing size issue is also a designing purpose of electrical connectors.

An electrical connector is disclosed in Taiwan Patent Application No. 087218667. The electrical connector is arranged at a surface of a printed circuit board. The electrical connector includes a housing, a receiving room leaded to a top surface and a bottom surface of the housing, a cyclic projection arranged at the bottom surface of the housing and surrounding the receiving room. An E-shape electrical contact has two fixed portions and a connection portion between the fixed portions. A soldering portion is arranged at a free end of the fixed portion and perpendicular to the fixed portion for soldering to the printed circuit board. While the housing and the E-shape electrical contact are assembled, the fixed portions of the E-shape electrical contact respectively contact both sides of the housing and the connection portion of the E-shape electrical contact is received in the receiving room of the housing.

However, the electrical connector has no engagement device for ensuring the E-shape electrical contact engaged with the housing securely. If a matching device unsuitable engages with the electrical connector, for example a contact of the matching device obliquely inserting into the receiving room and pressing the connection portion of the E-shape electrical contact, the E-shape electrical contact will depart from the housing via the pressing force from the contact of the matching device.

SUMMARY OF THE INVENTION

An object of the present invention is to provide an electrical connector capable of ensuring an electrical contact of the electrical connector securely engaged with an insulation of the electrical connector.

According to the invention, the electrical connector includes an insulation housing, an electrical contact and an engagement portion. The insulation housing has an insertion passage formed on a top surface thereon, a receiving space formed on a bottom surface thereon and leading to the insertion passage. The electrical contact covers the bottom surface and side surfaces of the insulation housing having a body portion covering the bottom surface of the insulation housing, an elastic connection portion arranged at a central area of the body portion and received in the receiving space of the insulation housing, sidewalls respectively arranged at opposite sides of the body portion and covering the side surfaces of the insulating housing, and soldering portions respectively arranged at a free end of the sidewalls. The engagement portion includes a projection member arranged at the side surface of the insulation housing and a fixing hole opened through the sidewall of the electrical contact for engaging with the projection member.

While a post shape contact of a matching device obliquely inserts into the insertion passage of the insulation housing and presses the elastic connection portion of the electrical contact, the electrical contact will engage with the insulation housing securely via the engagement portion for preventing the electrical contact departing of the electrical connector from the insulation housing of the electrical connector due to a pressing force from the post shape contact of the matching device.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
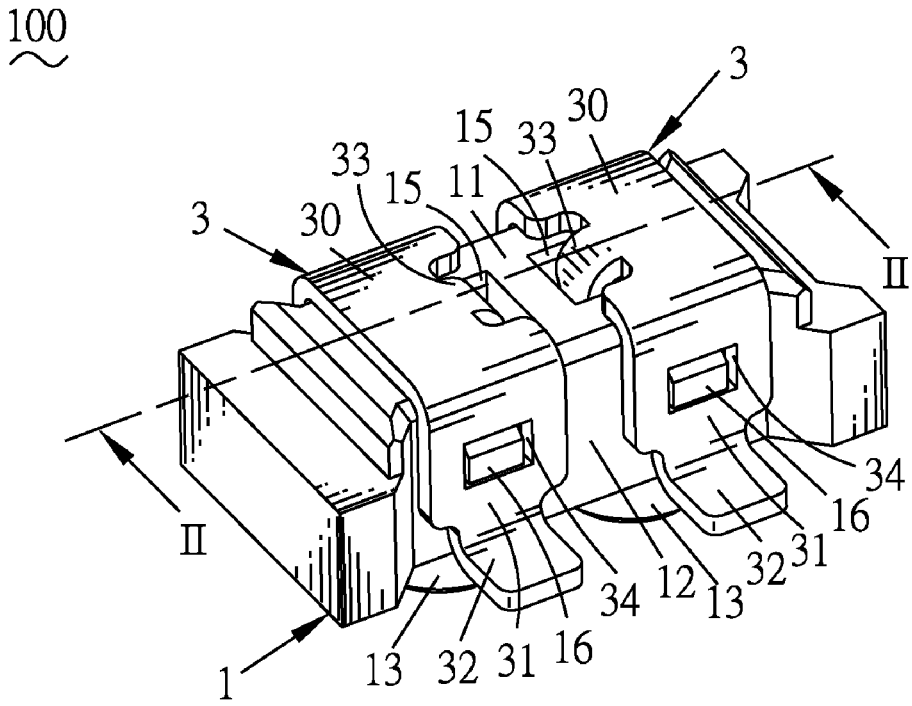
FIG. 1 is a perspective view of an electrical connector according to the present invention.

Firstly referring to FIG. 1 to FIG. 4, a preferred embodiment of an electrical connector 100 according to the present invention is a microphone connector disposed on a printed circuit board (not shown in figures). The electrical connector 100 has an insulation housing 1, an electrical contact 3 and an engagement portion.

The insulation housing 1 has a top surface 10, a bottom surface 11 opposite to the top surface 10 and at least two opposite side surfaces 12 respectively connecting the top surface 10 and the bottom surface 11. A cyclic projection 13 is mounted on the top surface 10 of the insulation housing 1. Further, the printed circuit board has a through hole (not shown in figures) for receiving the cyclic projection 13 of the insulation housing 1.

An insertion passage 14 is received in the insulation housing 1 and perpendicular to the top surface 10 of the insulation 1. One end of the insertion passage 14 is opened on a central area of the cyclic projection 13. A receiving space 15 is also received in the insulation housing 1 and perpendicular to the bottom surface 11. One end of the received space 15 is opened on the bottom surface 11 of the insulation 1. The receiving room 15 partially communicates the insertion passage 14.

Still referring to FIG. 1 to FIG. 4, the electrical contact 3 covers the bottom surface 11 and the side surfaces 12 of the insulation housing 1. The electrical contact 3 has a body portion 30 parallel to the bottom surface 11 and covering the bottom surface 11. At least two sidewalls 31 are extended from opposite sides of the body portion 30 and respectively cover the side surfaces 12 of the insulation housing 1. Further, the sidewalls 31 of the electrical contact 3 are also perpendicular to the body portion 30 and respectively parallel to the side surface 12 of the insulation housing 1.

A soldering portion 32 is extended from a free side of the sidewall 31 for soldering to the printed circuit board. The soldering portion 32 is perpendicular to the sidewall 31 and parallel to the top surface 10 of the insulation housing 1. An elastic connection portion 33 is curved and extended from a free side of the body portion 30 and received in the receiving room 15 of the insulation housing 1. In this case, the elastic connection portion 33 is formed to S-shape and partially projected to the insertion passage 14 of the insulation housing 1.

Figure 2:
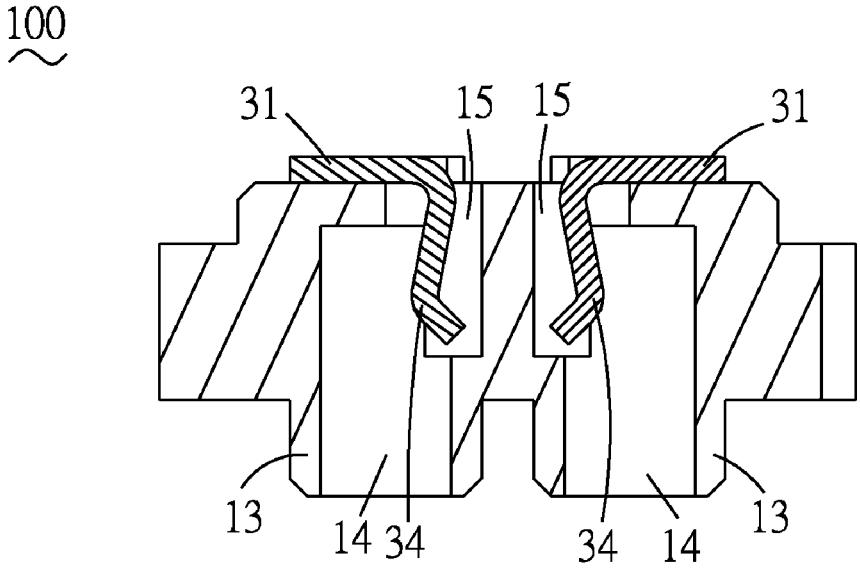
FIG. 2 is a cross-sectional view of the electrical connector along line II-II.
Figure 3:
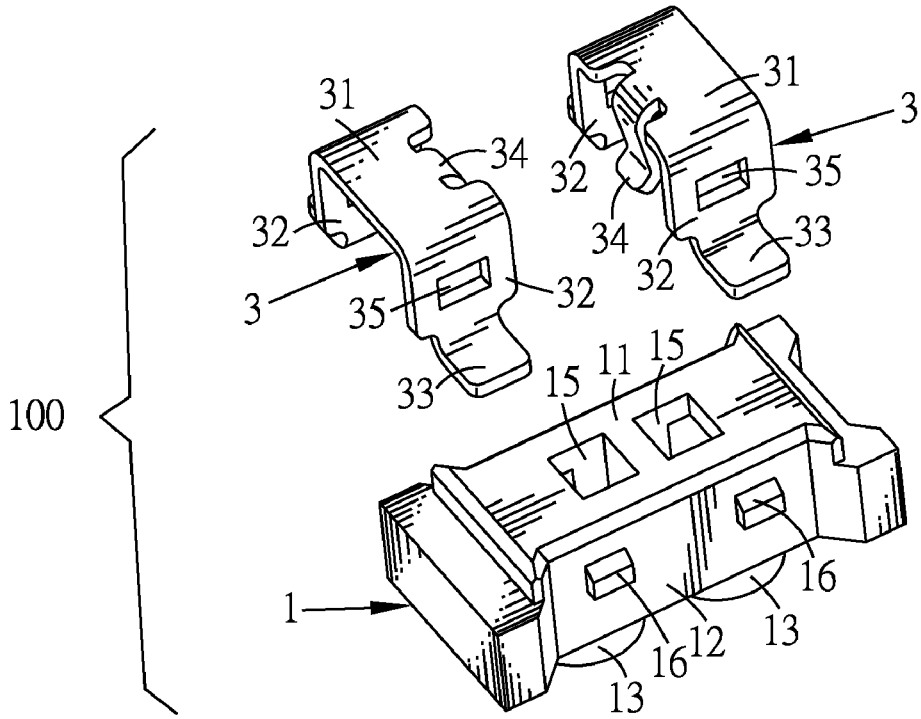
FIG. 3 is an exploded view showing a front side of the electrical connector.
Figure 4:
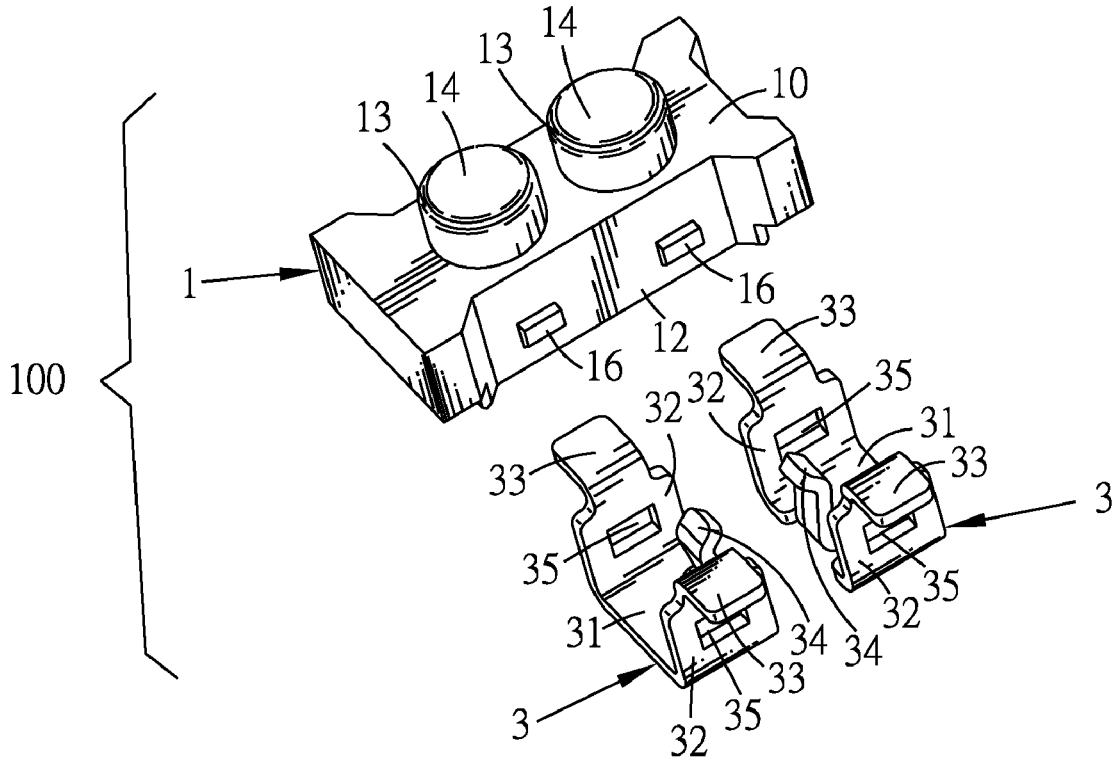
FIG. 4 is an exploded view showing a rear side of the electrical connector.

Referring to FIG. 1 to FIG. 4 again, the engagement portion includes a projection member 16 arranged at the side surface 12 of insulation housing 1 and a fixing hole 35 opened through the sidewall 31 of the electrical contact 3 for engaging with the projection member 16.

Figure 5:
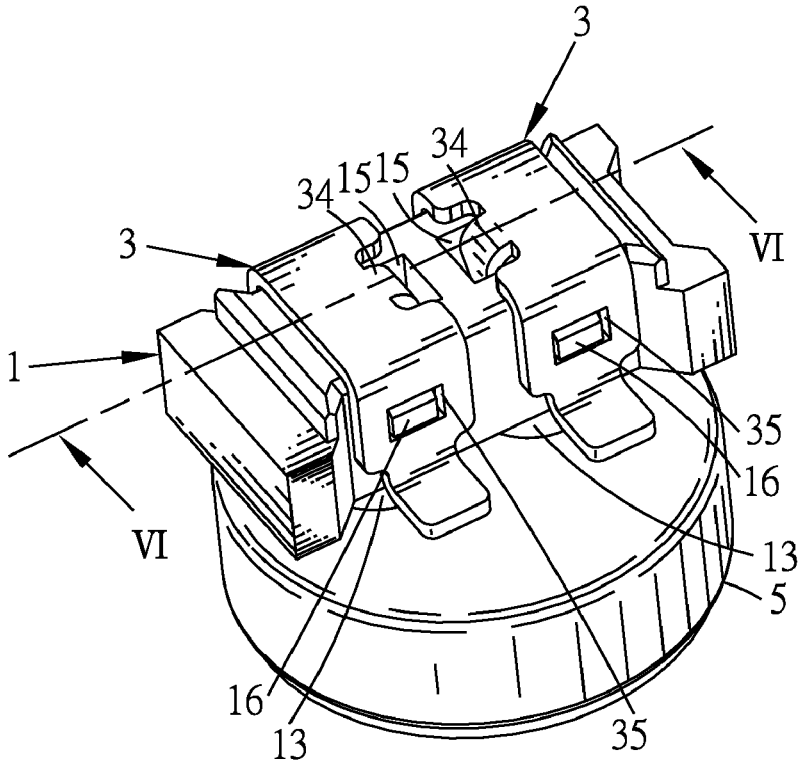
FIG. 5 is a perspective view showing a matching device engaged with the electrical connector.
Figure 6:
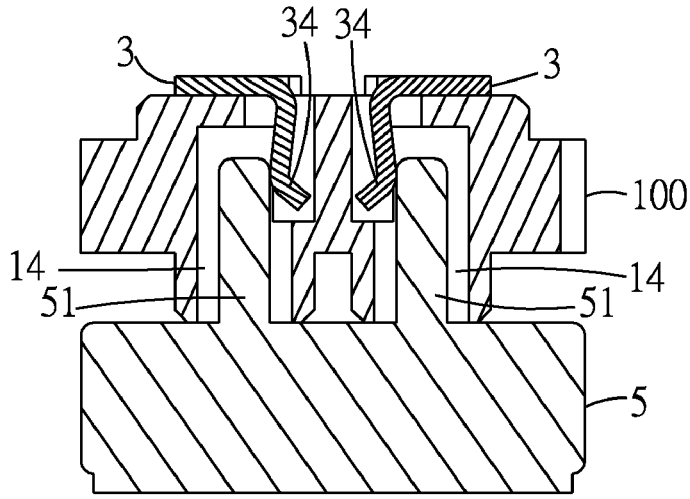
FIG. 6 is a cross-sectional view showing the matching device engaged with the electrical connector along line VI-VI.

Please refer to FIG. 5 and FIG. 6. While a matching device 5 such as a microphone, engages with the electrical connector 100, a post shape contact 51 of the matching device 5 is straightly inserted into the insertion passage 14 of the insulation housing 1 and pushes the elastic connection portion 33 of the electrical contact 3. Therefore, the elastic connection portion 33 moves back the receiving room 15 of the insulation housing 1 because the post shape contact 51 of the matching device 5 pushes the elastic connection portion 33 of the electrical contact 3, and electrical couples to the post shape contact 51 of the matching device 5.

Furthermore, if the post shape contact 50 of the matching device 5 is inserted obliquely into the insertion passage 14 of the insulation housing 1 and presses the elastic connection portion 33, the electrical contact 3 will engage the insulation housing 1 securely via the engagement portion for preventing the electrical contact 3 departing from the insulation housing 1 due to the pressing force from the post shape contact 50 of the matching device 5.

The foregoing description of various implementations has been presented for the purposes of illustration and description. It is not intended to be exhaustive or to limit the scope to the precise form disclosed. Many modifications and variations are possible in light of the above teaching. Such modifications and variations are intended to be included within the scope of this invention as defined by the accompanying claims.

What is claimed is:

1. An electrical connector disposed on a printed circuit board, comprising:

an insulation housing having a top surface, a bottom surface opposite to said top surface, two opposite side surfaces respectively connected to said top surface and said bottom surface, a cyclic projection arranged on said top surface, an insertion passage formed in a central area of said cyclic projection and perpendicular to said top surface, a receiving space formed on said bottom surface and perpendicular to said top surface, said receiving space partially communicated with said insertion passage;

an electrical contact covering said bottom surface and said side surfaces of said insulation housing having a body portion covering said bottom surface of said insulation housing, sidewalls extended from opposite sides of said body portion, said sidewalls perpendicular to said body portion and covering said side surfaces of said insulation housing, soldering portions respectively extended from a free side of said sidewalls and perpendicular to said sidewalls for soldering to said printed circuit board, an elastic connection portion curved and extended from a free side of said body portion and received in said receiving space of said insulation housing;

an engagement portion for engaging with said insulation housing and said electrical contact having a projection member arranged at said side surfaces of said insulation housing, a fixing hole opened through said sidewalls of said electrical contact for engaging with said projection member.

2. The electrical connector as claimed in claim 1, wherein said soldering portions are parallel to said top surface of said insulation housing.

3. The electrical connector as claimed in claim 1, wherein said elastic connection portion is partially projected to said insertion passage of said insulation housing.

4. The electrical connector as claimed in claim 1, wherein said elastic connection portion is formed to S-shape.

5. The electrical connector as claimed in claim 1, wherein said printed circuit board has a through hole for receiving said cyclic projection of said insulation housing.

6. The electrical connector as claimed in claim 1, wherein said electrical connector is a microphone connector.

* * * * *